US007017292B1

(12) United States Patent
Abelarde

(10) Patent No.: US 7,017,292 B1
(45) Date of Patent: Mar. 28, 2006

(54) COUNTDOWN CALENDAR

(76) Inventor: John J. Abelarde, 753 Larchlea Dr., Birmingham, MI (US) 48009

( * ) Notice: Subject to any disclaimer, the term of this patent is extended or adjusted under 35 U.S.C. 154(b) by 5 days.

(21) Appl. No.: 10/679,848

(22) Filed: Oct. 6, 2003

Related U.S. Application Data

(60) Provisional application No. 60/416,631, filed on Oct. 7, 2002.

(51) Int. Cl.
*G09D 3/00* (2006.01)

(52) U.S. Cl. ..... 40/110; 283/2; 283/99

(58) Field of Classification Search ..... 283/2, 283/99; 40/107, 110, 122; 434/304; 273/282.1, 273/282.3
See application file for complete search history.

(56) References Cited

U.S. PATENT DOCUMENTS 3,826,029 A * 7/1974 Lieberman ..... 40/107
4,058,916 A * 11/1977 Whyatt ..... 40/107
4,863,386 A * 9/1989 Maxey ..... 434/304
4,975,061 A 12/1990 Avrill
5,058,296 A 10/1991 Nötzel
5,090,733 A 2/1992 Bussiere ..... 283/2
5,443,288 A 8/1995 Miles ..... 283/2
D385,577 S 10/1997 Kennedy
5,799,423 A 9/1998 Malino ..... 40/107
5,934,707 A * 8/1999 Johnson ..... 283/2
6,186,553 B1 2/2001 Phillips et al.
6,280,200 B1 8/2001 Cunningham
6,324,777 B1 12/2001 Ngan
D458,303 S 6/2002 Daugherty
D458,632 S 6/2002 Negrete
D459,753 S 7/2002 Soneson

* cited by examiner

*Primary Examiner*—Joanne Silberman
(74) *Attorney, Agent, or Firm*—Pearne & Gordon LLP

(57) ABSTRACT

A countdown or advent type calendar for a selected time interval includes the concurrent provision of a text message and completion or modification of a pictorial design during the sequential indication of the date during the countdown.

19 Claims, 5 Drawing Sheets

COUNTDOWN CALENDAR

This application claims the priority of U.S. Provisional Application No. 60/416,631, filed Oct. 7, 2002.

BACKGROUND OF THE INVENTION AND RELATED ART

The present invention relates to countdown or advent type calendars corresponding to a selected time interval having a beginning date, an end date and a pictorial design and/or textural message relating to a theme associated with the time interval. The calendar may have any selected theme such as a recognized holiday or an arbitrarily designated time interval relating to events having a personal or familial significance such as a birthday, wedding, anniversary, vacation or the like.

The countdown calendars of interest herein track the arrival of a date. The calendars are particularly enjoyed by children as a means to quantify the time interval to the approaching event date and to heighten the anticipation of the event.

It is known to provide a date array with pocketed date locations for insertion of a marker element or separate mounting locations for numbered marker elements as taught in U.S. Pat. No. 4,975,061. Removal of marker elements from the date array during the countdown may reveal a personal message as taught in U.S. Pat. No. 6,186,553. Instead of removing marker elements, tabs may be arranged to be opened along fold lines to reveal a series of messages associated with the upcoming event as taught in U.S. Pat. Nos. 5,443,288 and 6,280,200.

Communication and educational calendars may enable a user to write a personal reminder message under a movable tab as in U.S. Pat. No. 2,831,278, receive a specific health or behavior modification message related to a goal as in U.S. Pat. No. 5,207,580, or disclose an inspirational or motivational message on movable tabs assembled to highlight or form a pictorial design as taught in U.S. Pat. No. 5,090,733.

SUMMARY OF THE INVENTION

In accordance with the invention, a countdown calendar for a selected event is enhanced by the concurrent provision of a text message and completion or modification of a pictorial design during the quantification of the time interval preceding the event. The sequential indication of date during the countdown provides for the development of the text message and design.

In an illustrated embodiment, the sequential indication of the countdown date reveals a text message or greeting relating to the event and completes or modifies an associated pictorial design or forms a second text message.

To that end, date marker elements moved during the countdown progressively reveal the letters forming a text message. As the marker elements are moved during the countdown, they are repositioned to complete a design. The marker elements may bear portions of a more comprehensive design or may comprise individual features of the more comprehensive design. The marker elements may be coded to fix their position upon movement.

The calendar includes a support substrate having a date location which may include a date array and a target location which may include a pictorial design and/or coded target locations for repositioning of marker elements.

The marker elements may be temporarily mounted to or removably secured to the substrate at the date location and target locations using any convenient method of attachment. For example, the marker elements may be temporarily mounted or removably secured by magnets, hook and loop fasteners, non-hardening adhesive, e.g. pressure-sensitive adhesive, interlocking members such a snap connectors, or in other suitable manners as taught in U.S. Pat. Nos. 5,799,423, 5,934,707, D385,577 and D458,061. It is also possible to use static cling to mount a polymeric film material as taught in U.S. Pat. No. 6,324,777. The teachings of the foregoing patents are incorporated herein by reference.

In a further embodiment, the marker elements may comprise three-dimensional bodies or pieces that mechanically interfit with the support substrate. For example, the marker element cross-section may be circular, oval, polygonal, rectangular (including square) or other regular or irregular geometric shapes having multiple faces that are mirror images and configurations that allow the marker element to be mounted in a target location with a selected one of the mirror image faces exposed.

Accordingly, the marker elements may be oriented and mounted to the substrate to expose different faces. One of the faces may carry countdown numbers or dates and one or more other faces may carry a text message or a letter, a pictorial design, an image comprising a part of a more comprehensive design or a combination thereof. The marker elements may be removed, rotated or reoriented to change the exposed face and remounted in it's date location or moved to a target location.

DETAILED DESCRIPTION OF THE INVENTION

Figure 1:
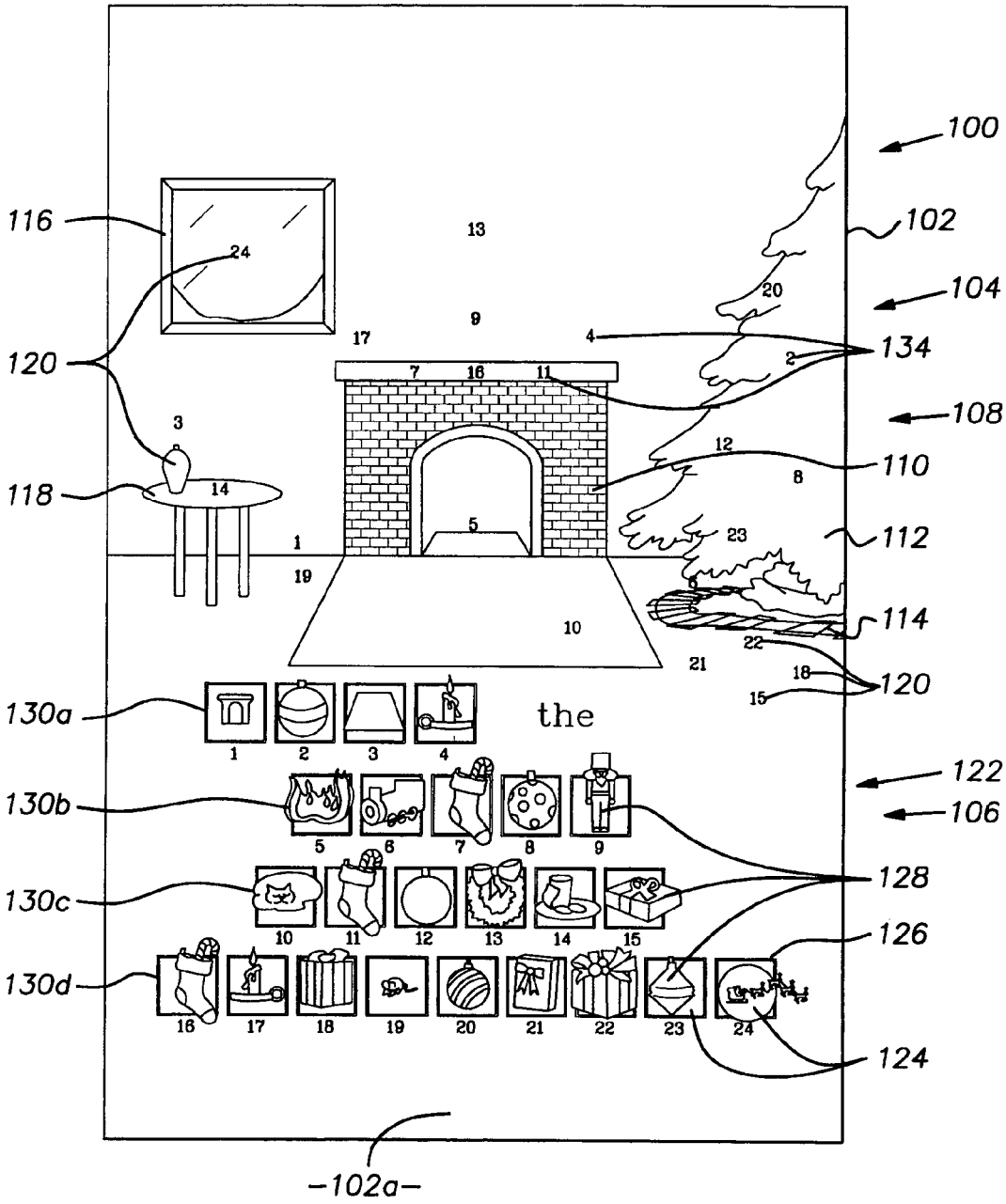
FIG. 1 is a front elevational view of a Christmas countdown calendar prior to the beginning of the countdown.

Referring to FIG. 1, a countdown calendar 100 having a Christmas theme is illustrated. The calendar 100 includes a substrate 102 having a design portion 104 and a date portion may be formed of non-woven fabric, similar sheet material that may be printed or otherwise marked on a front or display surface 102*a* with the features of the design and date portions. The design portion 104 includes an illustrative Christmas scene 108 comprising a room having a fireplace 106. The substrate 102 cardboard, plastic or a 110, a Christmas tree 112, a toy train track 114, a room window 116 and a table 118. Of course, other Christmas scenes may be used. In a like manner, design portion scenes related to other calendar themes may be used. For example, a Halloween countdown calendar may include a ghost scene, a Thanksgiving countdown calendar may include a Pilgrim dinner celebration scene and a birthday countdown calendar may include a cake or other birthday celebration indicia. Similar event related scenes may be used in connection with other recognized holidays such as Valentine's Day, New Year's Day, Easter, Independence Day, St. Patrick's Day, Mother's Day, Father's Day, Memorial Day or Labor Day.

As shown in FIG. 1, the Christmas scene 108 includes number coded target locations 120. A total of 24 target locations 120 are contained in the Christmas scene 108. Each of the target locations 120 is number coded 1 through 24. The target locations 120 need not be number coded, but rather, they may be coded with letters, colors, designs, specific shapes or other indicia suitable for recognition by children.

The date portion 106 of the calendar 100 comprises a date array 122 formed by a plurality of date locations 124. Each date location 124 includes a square border 126 within which a marker element 128 is temporarily mounting to the front surface 102*a* of the substrate 102.

The date locations 124 may be defined in any convenient manner such as by the use of square borders 126, other suitable geometric shapes, color designs or merely numbered. The date array 122 comprises a total of 24 date locations which corresponds with the number of days in the time interval or countdown period. Of course, the number of date locations and the length of the time interval or countdown may be varied. Each of the date locations 124 is number coded 1 through 24 and corresponds with a day of the countdown time interval. The date array 122 comprises four rows 130*a*, 130*b*, 130*c* and 130*d* of date locations 124. The rows 130*a*, 130*b*, 130*c* and 130*d* respectively contain a total of 4, 5, 6 and 9 date locations 124. The configuration of the date array 122 may be varied so as to include arcuate as well as combined arcuate and linear date location alignments. However, vertically spaced horizontal rows are convenient since removal of the marker elements 128 reveals a text message.

The date marker elements 128 have specific configurations and/or pictorial representations on a front or display side thereof corresponding with additional features or aspects to be added to the design portion 104 to complete or modify the Christmas scene 108. A total of 24 marker elements 128 are provided. The marker elements 128 are number coded 1 through 24 so that each marker element is associated with an appropriate date location 124 and, upon repositioning, a proper target location 120 to complete or modify the Christmas scene 108.

Figure 2:
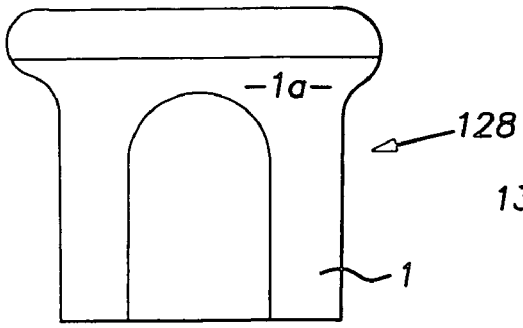
FIG. 2 is a front elevational view of on an enlarged scale of a marker element shown in FIG. 1.
Figure 3:
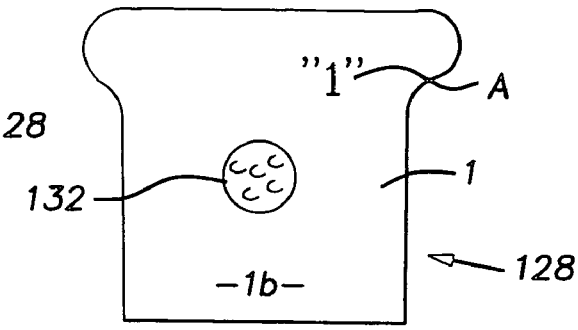
FIG. 3 is a rear elevational view of the marker element shown in FIG. 2.

Referring to FIGS. 2 and 3, the marker element 128 associated with date location 1 is shown and referred to as marker element "I" herein. The marker element 1 has a front surface 1*a* and a back surface 1*b*. The front surface 1*a* is decorated to depict a mouse hole that is to be added to the Christmas scene 108. The back surface 1*b* is marked with the particular element number, i.e., "1" herein as shown at "A", and has a hook fastener 132 secured thereto.

For purposes of removably mounting the marker elements 128 to the front face 102*a* of the substrate 102, each of the date locations 124 and target locations 120 has a loop fastener 134 secured to the front face 102*a* in any suitable manner such as by adhesive or sewing. Accordingly, the marker elements 128 may be moved between their date locations 124 and target locations 120 by disengaging the hook fasteners 132 from the loop fasteners 134 at the date locations 124 and reengaging the hook fasteners 132 with the loop fasteners 134 at the target locations 120. It should be appreciated that the non-woven fabric forming the substrate 102 may be of sufficiently loose construction to provide the loop function and enable the elimination of the loop fasteners 134.

Figure 4:
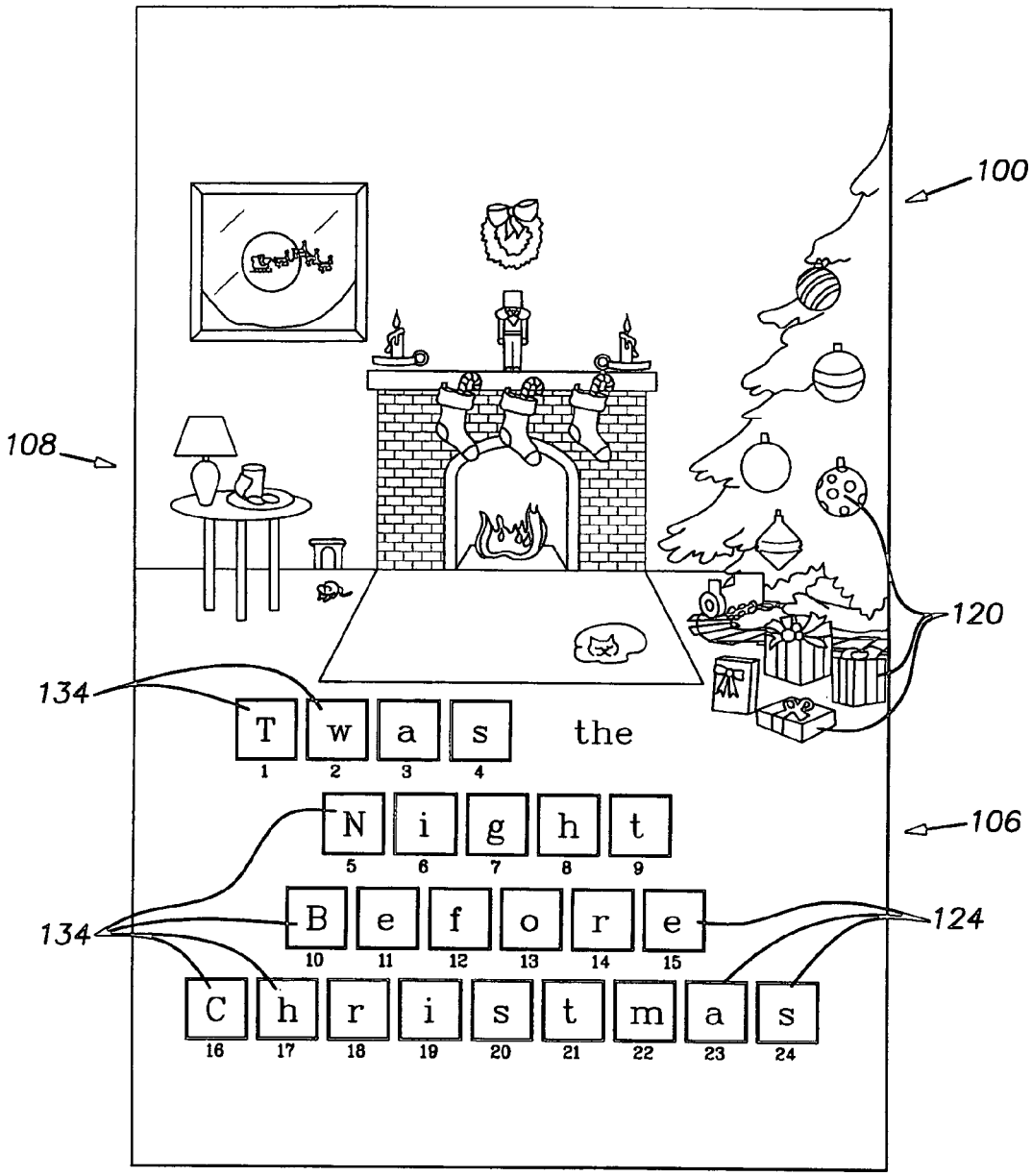
FIG. 4 is a front elevational view of the calendar of FIG. 1 after the countdown is completed and the marker elements have been moved from their date locations to their target locations.

At the completion of the countdown, all of the marker elements 128 have been moved from their date locations 124 to the target locations 120 and the Christmas scene 108 has been completed and the calendar 100 appears as shown in FIG. 4. A text message "Twas the Night Before Christmas" appears at the date portion 106 and the Christmas scene 108 in the design portion 104 is modified or completed.

Figure 5:
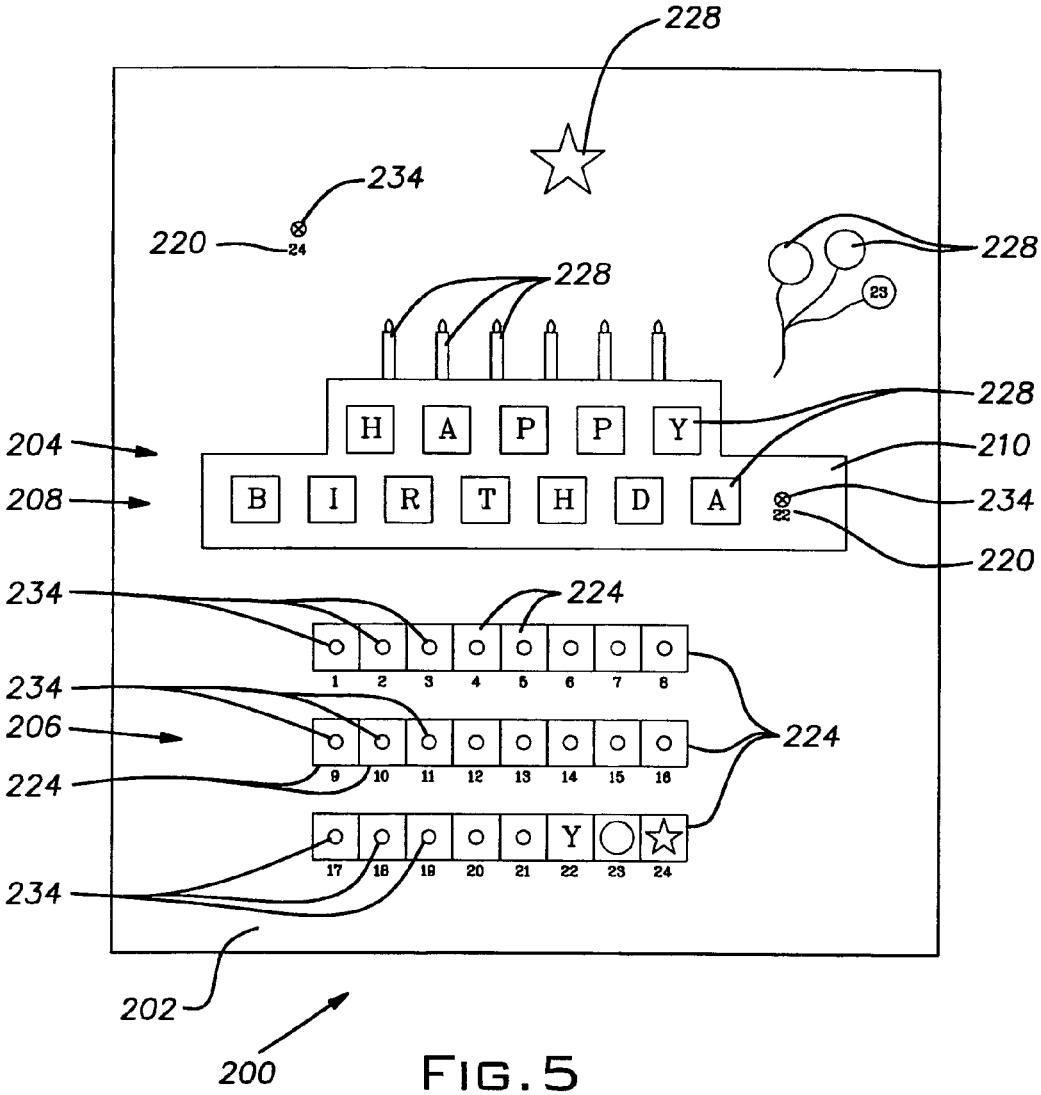
FIG. 5 is a front elevational view of a birthday countdown calendar in accordance with a second embodiment of the invention.

Referring to FIG. 5, a further embodiment of a countdown calendar 200 is shown. For convenience, the same reference numerals as used in the description of the prior embodiment will be used herein with the addition of 100.

In this instance, the calendar 200 includes a substrate 202 having a design portion 204 and a date portion 206. The calendar 200 relates to a birthday, and the design portion 204 depicts a birthday celebration scene 208 including a cake 210.

As shown in FIG. 5, the birthday scene 208 includes number coded target locations 220 arranged in an array on the cake 210. In this embodiment, the marker elements 228 are moved during the countdown to complete the pictorial design of the birthday scene 208 and also to form a birthday greeting. For convenience, all of the marker elements 228 are shown in their target locations 220 except for the elements "22", "23" and "24" which are in their date locations 224.

Alternatively, it should be appreciated that a chart may be provided on the back side of the substrates 102 and 202 showing each of the marker elements and its corresponding number, color or other code to be used in positioning the element at the proper date and target locations.

Figure 6:
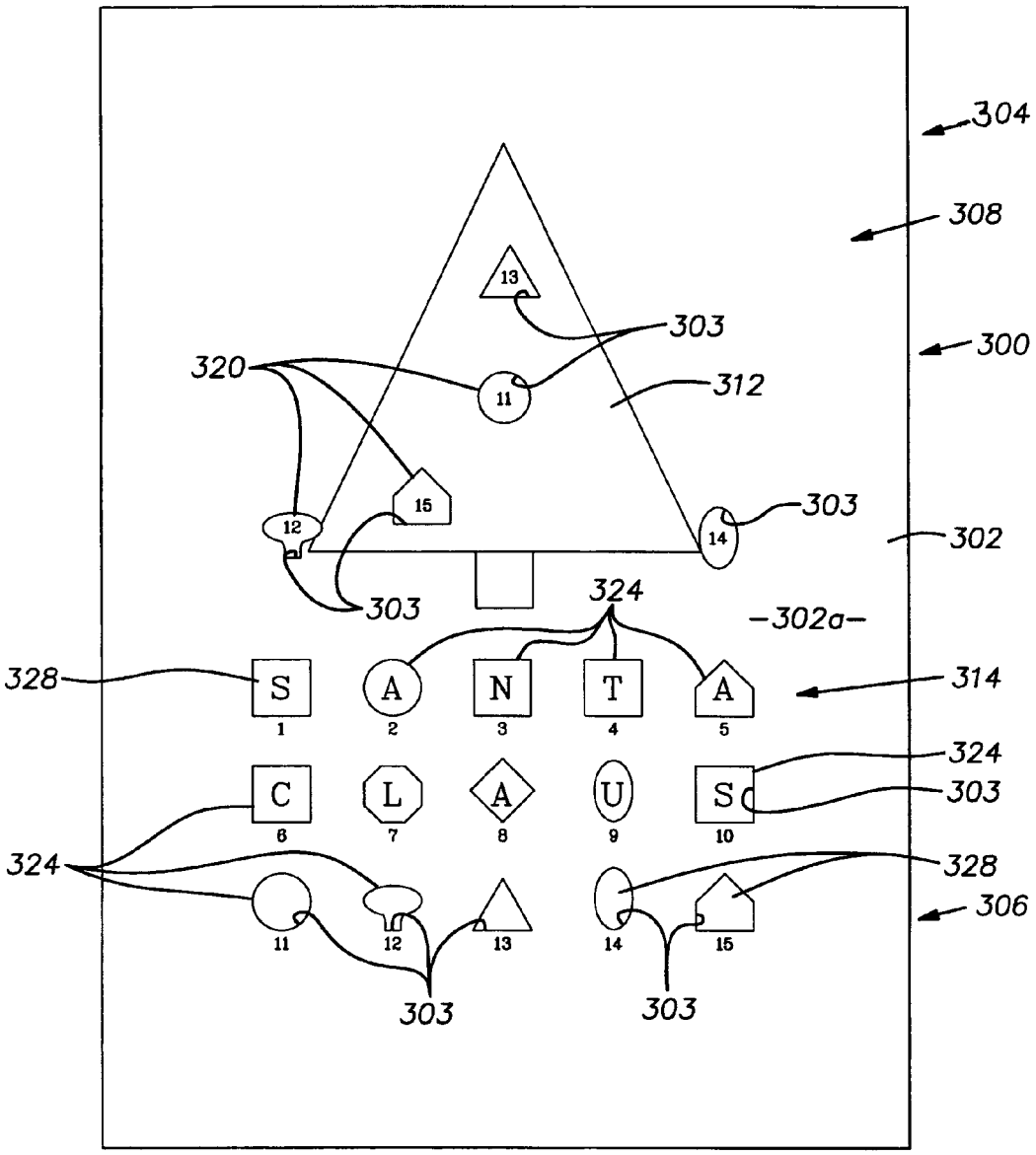
FIG. 6 is a front elevational view of a Christmas countdown calendar in accordance with a third embodiment of the invention.

Referring to FIG. 6, a countdown calendar 300 having a Christmas theme is illustrated. The calendar 300 includes a substrate 302 having a design portion 304 and a date portion 306. A front or display surface 302*a* of the substrate 302 is marked with various pictorial or text features in the design and date portions.

In this instance, the substrate 302 is formed of a more rigid material such as wood, plastic or a similar material that is sufficiently rigid to have mounting cavities or recesses 303 formed therein for receiving and mounting the marker elements 328 as described below. For example, the substrate 302 and marker elements 328 may be formed of wood. It is also possible to form the substrate 302 of a plastic sheet material that may be thermoformed or vacuum formed to provide the recesses 303 and, similarly, the same plastic material may be used to form the three-dimensional bodies of the marker elements 328. Suitable plastics include acrylonitrile-butadiene styrene, high impact polystyrene, polyethylene, polyvinylchloride and acrylic.

The design portion 304 includes an illustrative Christmas tree scene 308 comprising a Christmas tree 312. In this embodiment, the date portion 306 includes a text message by 314. For illustration, the marker elements 328 for date locations 324 numbered 1 through 10 are shown in their reverse or message positions in date locations 320. That is, upon expiration of days 1 through 10, the marker elements 328 have been reversed sequentially during the countdown so as to show that text message "Santa Claus".

On the other hand, none of the marker elements 328 in the date locations 324 numbered 11 through 15 have been moved to their target locations 320 on the Christmas tree 312. Accordingly, the recesses 303 are visible.

Figure 7:
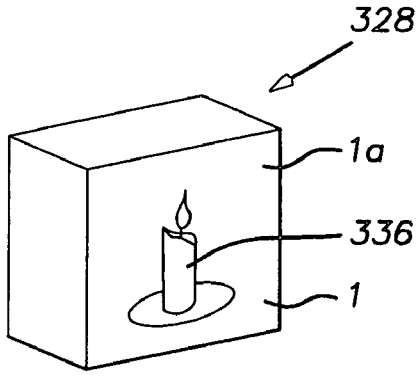
FIG. 7 is a front perspective view on an enlarged scale of a marker element shown in FIG. 6.
Figure 8:
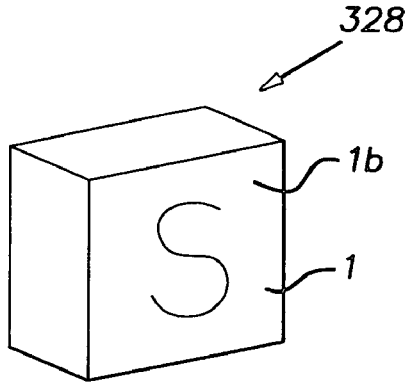
FIG. 8 is a rear perspective view of the marker element shown in FIG. 7.

Referring to FIGS. 7 and 8, the marker element 328 corresponding with the number "1" date location 324 is shown. As shown, the marker element 1 has a cubic shape including a first face 1*a* having a Christmas candle 336 decoration or design. At the end of the first day, the marker element 1 is withdrawn from the recess 303 at the date location 324, rotated and reinserted in the recess so as to expose a second face 1*b* bearing the letter "S".

The marker element 328 may have a thickness dimension extending between the faces 1*a* and 1*b* substantially equal to the depth of the recess 303 so that the calendar is assembled to a flat or planar condition similar to a jigsaw puzzle. For younger children, the marker element 328 may have a thickness dimension greater than the depth of the recess 303 to permit gripping the element during removal from the recess.

Figure 9:
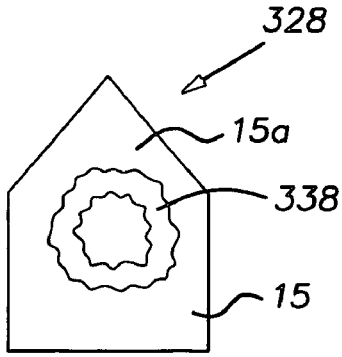
FIG. 9 is a front perspective view on an enlarged scale of a marker element shown in FIG. 6.
Figure 10:
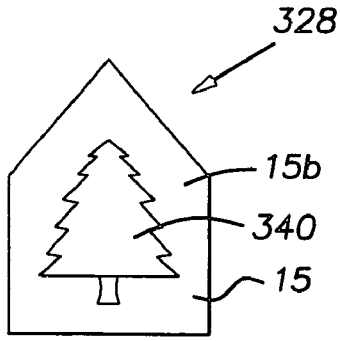
FIG. 10 is a front elevational rear perspective view of the marker element shown in FIG. 9.

Referring to FIGS. 9 and 10, the marker element 328 corresponding with the number "15" date location 324 is shown. As shown, a first face 15*a* of the number 15 marker element includes a Christmas wreath 338. A second face 15*b* includes a Christmas tree 340. Accordingly, the marker element 15 may be moved from its date location to the target location 320 numbered 15 shown on the Christmas tree 312 with either the Christmas wreath 338 or Christmas tree 340 shown as a decorative feature of the Christmas tree 312.

It should be appreciated that each of the marker elements 328 may be provided with a different geometric shape. For example, the marker elements may be shaped or provided with peripheral or side configurations in the thickness direction such that each marker element fits in only one recess at the date location and only one recess at the target location. Accordingly, there would be no need to number or otherwise code the marker elements and corresponding date and/or target locations.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A theme calendar having a front and comprising substrate support means, date locations on said substrate support means corresponding with time periods of a countdown time interval, a plurality of separately mountable marker elements, each marker element being removably mounted to said substrate support means at said date location, a pictorial design carried on said substrate means, said pictorial design including a plurality of separate target locations, each having a distinguishing designation for removably mounting an associated one of said marker elements having a corresponding designation, said marker elements being movable from said date locations and mountable to said associated target locations in accordance with the expiration of said time periods, each of said marker elements including design features that are visible from the front of said theme calendar when said marker element is mounted to said substrate support means at said associated target location, movement of said marker elements from said date locations to said associated target locations revealing a first text message at said date locations and completing or modifying said pictorial design or forming a second text message at said target locations with said marker elements mounted in said associated separate target locations.

2. The calendar of claim 1, wherein said time interval corresponds to a recognized holiday or an event having personal or familial significance.

3. The calendar of claim 2, wherein be event having personal or familial significance is a birthday, an anniversary, a vacation, an upcoming trip, a wedding, a religious occasion, a graduation, or a recognized holiday.

4. The calendar of claim 2, wherein said recognized holiday is Halloween, Valentine's Day, Thanksgiving, New Year's Day, Easter, Independence Day, St. Patrick's Day, Mother's Day, Father's Day, Memorial Day or Labor Day.

5. The calendar of claim 1, wherein said pictorial design comprises one or more design elements that are suggestive of an event associated with said time interval.

6. The calendar of claim 1, wherein said pictorial design comprises one or more design elements that are suggestive of an event associated with said time interval and a text message formed by said marker elements in their target locations.

7. The calendar of claim 1, wherein said substrate is formed of a non-woven fabric, cardboard, plastic, wood or a similar material that may be printed or otherwise marked on a front or display surface with said text message and/or pictorial design.

8. The calendar of claim 1, wherein said marker elements are temporarily mounted or removably secured to said substrate by magnets, hook and loop fasteners, pressure-sensitive adhesive, mechanical interfit with said substrate, or interlocking members or snap connectors.

9. The calendar of claim 1, said substrate is formed of a non-woven fabric, cardboard, plastic, wood or a similar material that may be printed or otherwise marked on a front or display surface with said pictorial design, and said marker elements are temporarily mounted or removably secured to said substrate by one of magnets, hook and loop fasteners, pressure-sensitive adhesive, interlocking members or snap connectors.

10. The calendar of claim 1, wherein said marker elements are three-dimensional bodies having a plurality of marker faces bearing text, pictorial designs, or combinations thereof, and said marker elements are removably mounted in recesses at said date and target locations with a selected one of said marker faces exposed.

11. The calendar of claim 10, wherein said three dimensional bodies and recesses are shaped so that each of said three dimensional bodies fits in only one of said recesses at said date location and only one of said recesses at said target location.

12. The calendar of claim 10, wherein said three dimensional bodies and recesses have peripheral side configurations, and said peripheral side configurations are selected so that each of said three dimensional bodies fits in only one of said recesses at said date location and only one of said recesses at said target location.

13. The theme calendar of claim 1, wherein said separate target locations comprise numbered distinct areas of said pictorial design and said associated marker elements are correspondingly numbered.

14. The theme calendar of claim 13, wherein said date locations are separate date areas arranged in an array on said substrate support and said array is visible from the front of said theme calendar with said marker elements being removably mounted to said separate date areas.

15. The theme calendar of claim 1, wherein said marker elements complete or modify said pictorial design and form a second text message at said target locations.

16. A theme calendar having a front and comprising substrate support means, date locations on said substrate support means corresponding with time periods of a countdown time interval, a plurality of separately mountable coded marker elements, said marker elements being removably mounted to said substrate support means at said date locations, a pictorial design carried on said substrate means, said pictorial design including a plurality of disjunct and coded target locations for removably mounting an associated one of said marker elements correspondingly coded, said marker elements being movable from said date locations and mountable to said associated target locations in accordance with the expiration of said time periods, said marker elements including design features that are visible from the front of said theme calendar when said marker elements are mounted to said substrate support means at said associated target locations, movement of said marker elements from said date locations to said associated target locations revealing a first text message at said date locations and completing or modifying said pictorial design or forming a second text message at said target locations with said marker elements mounted in said associated disjunct and coded target locations.

17. The calendar of claim 16, wherein said disjunct and coded target locations comprise separate numbered areas of said pictorial design and said associated marker elements are correspondingly numbered.

18. The theme calendar of claim 17, wherein said date locations are separate date areas arranged in an array on said substrate support and said array is visible from the front of said theme calendar with said marker elements being removably mounted to said separate date areas.

19. The theme calendar of claim 16, wherein said marker elements complete or modify said pictorial design and form a second text message at said target locations.

* * * * *